United States Patent [19]

Radford et al.

[11] Patent Number: 4,605,075

[45] Date of Patent: Aug. 12, 1986

[54] SHROUDED CORE CATCHER

[75] Inventors: Steven R. Radford, West Jordan; J. Stanley Davis, Sandy, both of Utah

[73] Assignee: Norton Christensen, Inc., Salt Lake City, Utah

[21] Appl. No.: 646,576

[22] Filed: Aug. 31, 1984

[51] Int. Cl.[4] ..... E21B 25/00; E21B 49/02

[52] U.S. Cl. ..... 175/58; 175/246; 175/250

[58] Field of Search ..... 175/20, 58, 226, 244–251, 175/253, 255, 257, 268, 309, 404; 166/318

[56] References Cited

U.S. PATENT DOCUMENTS

| | | | |
|---|---|---|---|
| 1,717,271 | 6/1929 | Simmons | 175/250 |
| 1,790,542 | 1/1931 | Harvey | 175/246 |
| 2,643,858 | 6/1953 | Hardman | 175/246 X |
| 3,739,865 | 6/1973 | Wolda | 175/244 |
| 3,878,904 | 4/1975 | Dobson | 175/58 X |

FOREIGN PATENT DOCUMENTS

| | | | |
|---|---|---|---|
| 669926 | 9/1963 | Canada | 175/246 |
| 1222526 | 2/1971 | United Kingdom | 175/250 |
| 1106891 | 8/1984 | U.S.S.R. | 175/20 |

*Primary Examiner*—Stuart S. Levy

*Assistant Examiner*—Thomas R. Hannon

*Attorney, Agent, or Firm*—Beehler, Pavitt, Siegemund, Jagger, Martella & Dawes

[57] ABSTRACT

A fragmented or unconsolidated core can be cut and retained within a coring tool without substantial disturbance of the core by the use of a shrouded core catcher. A core catcher is concentrically disposed within the coring tool and outside of a smooth, cylindrical sleeve telescopically disposed inside of the core catcher. The core catcher in turn is coupled to a lower assembly which can be selectively longitudinally fixed within the coring tool, but which is otherwise temporarily coupled to the sleeve. As the sleeve is longitudinally pulled upward after the completion of the coring operation, the lower assembly becomes longitudinally fixed within the coring tool and the sleeve, which heretofore has fully covered and concealed the core catcher, begins to be withdrawn from the core catcher, leaving it unconcealed. Ultimately, the core catcher is at least partially uncovered, thereby permitting activation and contact between the core catcher and the core disposed within the coring tool. However, at all times during the coring operation, the core catcher remains concealed behind the cylindrical sleeve which extends in the coring tool throughout the substantial length of the core.

7 Claims, 3 Drawing Figures

118
120
104
116
130
114
131
134
132
130
136
102
140
112
128
124
124
122
126
114
138
106
110
100
108

SHROUDED CORE CATCHER

BACKGROUND OF THE INVENTION

1. Field of the Invention

The present invention relates to the field of earth-boring tools and, more particularly, to core catchers as used in coring tools.

2. Description of the Prior Art

Despite recent advances made with respect to logging and measurements while drilling, the best and primary means presently used in the petroleum industry for ascertaining the nature of the rock formation being drilled is to take a physical core sample. In a typical coring tool, the tool includes a coring bit connected to one or more bit shoes to a coring barrel. The coring barrel includes a mechanism for receiving the core and otherwise performing the required downhole coring operations. Chief among these operations is the seizure and retention of the core in the coring barrel for a retrieval to the well surface.

The prior art has developed a wide variety of core catchers which are installed within the coring tool for securing and retaining the core within the core barrel once it has been cut. In the case where the rock formation is highly consolidated, the core is highly integral, and it is only necessary to break the core from the rock fomration and to jam or wedge the bottom of the core within the coring tool for complete retrieval. Such prior art core catchers are operative by means of a frictional, diametral contact between the cut core and the core catcher. The core catcher allows the core to slide upwardly, but when coring is completed and the core barrel raised, the frictional fit between the core catcher and the core causes the core catcher to be jammed tightly against the core, thereby retaining the core within the tool.

However, in fractured or highly unconsolidated formations, any type of diametral friction, contact or means which might disturb the core composition, as it is being cut and loaded within the core barrel, can seriously and substantially interfere or alter the physical arrangement and configuration of earth materials within the fragmented or unconsolidated core.

Therefore, what is needed is a core catcher capable of retaining a fragmented and unconsolidated core within the tool, yet still comprise a tool which accepts the cut core without any substantial disturbance of the core.

BRIEF SUMMARY OF THE INVENTION

The present invention is an improvement in a coring tool for cutting the core comprising a core catcher disposed within the coring tool and a smooth, cylindrical sleeve, also disposed witin the coring tool. The sleeve is concentrically disposed inside of the core catcher, and fully covers the core catcher. The sleeve provides a smooth, continuous surface of contact with the core, and is selectively displaceable with respect to the core catcher to ultimately fully uncover the core catcher. A mechanism is also included for selectively activating or causing the core catcher to seize or retain the core within the coring tool. By this combination of elements, disruptive contact between the core catcher and the core is substantially eliminated.

The present invention can also be characterized as an improvement in a coring tool for cutting the core, which coring tool includes an inner tube which is longitudinally displaceable within the coring tool. The improvement comprises a smooth inner cylindrical sleeve for receiving the core, a core catcher concentrically disposed outside of the sleeve and concealed from the core by the sleeve, and a mechanism coupled to the sleeve and core catcher for temporarily longitudinally coupling the core catcher in the sleeve in a first configuration. In the first configuration, the sleeve fully covers the core catcher. The mechanism then selectively decouples the core catcher in the sleeve, and permits the core catcher and sleeve to assume a second configuration. The second configuration is one which allows relative longitudinal displacement of the sleeve with respect to the core catcher to thereby uncover the core catcher and permit contact between the core and the core catcher. Again, by reason of this combination of elements, disruptive or interfering contact between the core catcher and the core is substantially eliminated.

The present invention also includes a method for cutting and disposing of core within a coring tool without substantial disturbance of the core. The method comprises the steps of cutting the core, disposing the cut core within a smooth cylindrical sleeve, longitudinally displacing the sleeve within the coring tool to expose the core catcher, and thence activating the core catcher to retain the core within the coring tool. By reason of this combination of steps, a core is cut and disposed within the coring tool without substantial disturbance of the core.

The invention and its various embodiments may be better understood by now turning to the following drawings wherein like elements are referenced by like numerals.

These and other embodiments of the invention are better understood by now turning to the following detailed description.

DETAILED DESCRIPTION OF THE PREFERRED EMBODIMENTS

The present invention is a means for concealing or providing a full shroud for a core catcher. In the preferred embodiments a thin, smooth sleeve is incorporated into the coring barrel design behind which sleeve the core catcher is disposed. Therefore, the core is exposed to a perfectly smooth, cylindrical surface from the time it leaves the inner gage of the core bit and passes upwardly through the bit shoes into the core barrel. Such a smooth transition within the coring tool is particularly useful in fractured formations which are susceptible to becoming disoriented and scrambled by conventional core catchers. Although in the following detailed description various embodiments of particular core catchers are illustrated, any type of core catcher now known or later devised can be shielded or shrouded and selectively activated upon exposure according to the invention.

Figure 1:
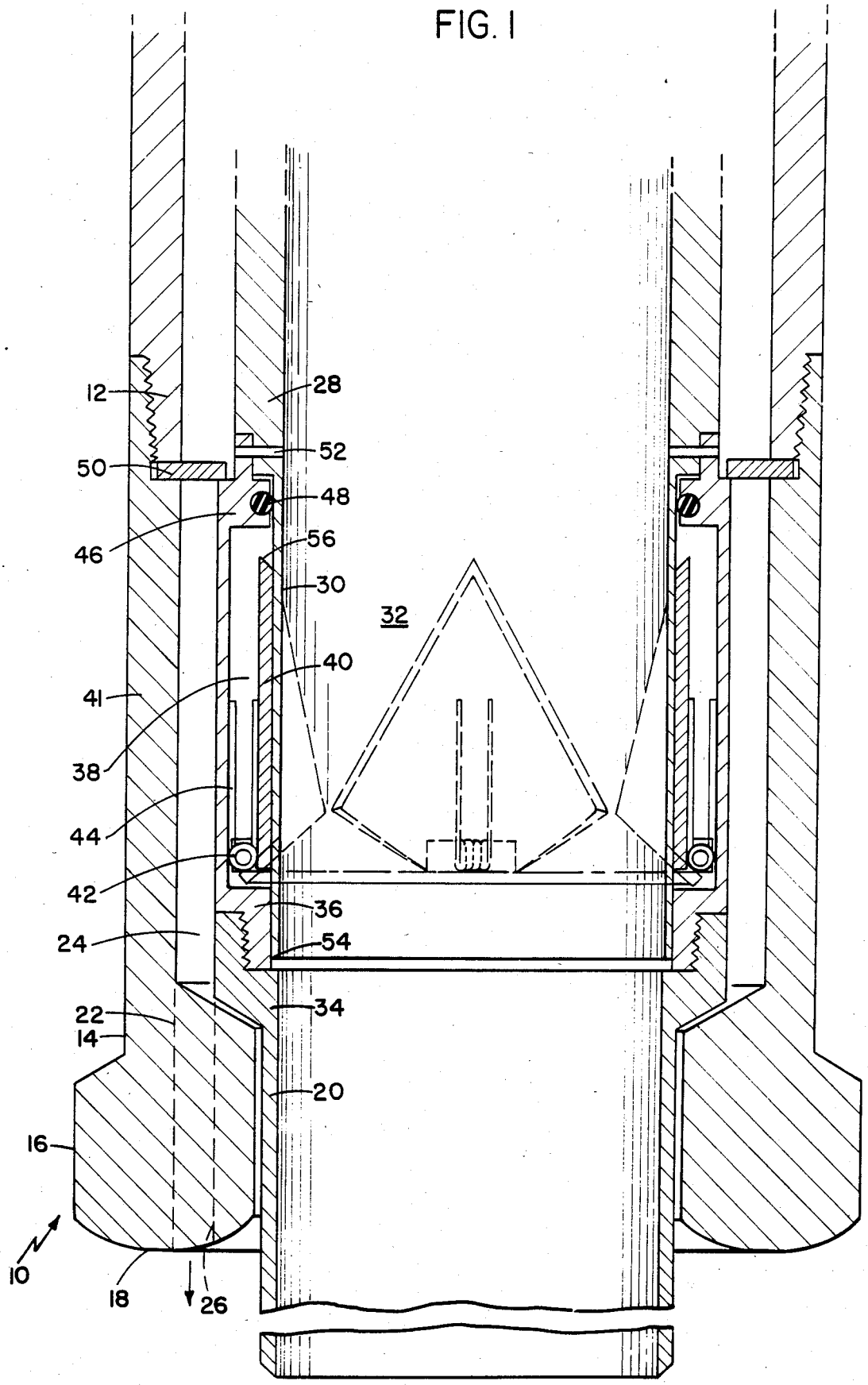
FIG. 1 is a cross-sectional view of a first embodiment of a shrouded core catcher as used in punch coring.

Turn first to the embodiment illustrated in cross-sectional view in FIG. 1. FIG. 1 illustrates the lower part of a coring tool showing, for example, a conventional coring bit 10 coupled to a bit sub 12 of which only the lower threading is shown. In the embodiment of FIG. 1, the coring tool is a punch coring tool which is an application well known to the art. Bit 10 is diagrammatically depicted, and is shown as including a shank portion 14, outer gage 16, crown 18, and inner gage 20. A bit face hydraulic duct 22 is shown as defined through bit 10 from interior 24 of the coring tool, through the bit and terminating in an open nozzle or port 26.

An inner barrel 28 is axially and telescopically disposed within the coring tool. Inner barrel 28 is modified at its lower portion to form a thin sleeve extension 30. Sleeve 30 may be integral with inner barrel 28, or conventionally coupled thereto. Sleeve 30 forms a smooth cylindrical surface within interior 32 of the coring tool, and extends entirely to the upper portion of a conventional cylindrical core punch 34. Core punch 34 in turn is threadably connected to a cylindrical lower assembly 36. Lower assembly 36 is concentrically disposed radially outside of cylindrical sleeve 30 and defines an annular space 38 between assembly 36 and inner concentric sleeve 30. A full closure core catcher is disposed within annular space 38 and attached to assembly 36 by means of a spring biased hinge 42. A singular or plurality of generally triangular core catcher flapper valves 40 collectively comprise the full closure core catcher within the coring tool and serve in a conventional manner to move radially inward about the pivot pin of hinge 42 to provide a full or nearly complete closure of space 32 within the coring tool in a manner as described below. Hinge 42 includes springs 44 which are heavy torsion springs which tend to urge flapper valves 40 outwardly into space 32 once flapper valve 40 is fully exposed or activated.

Assembly 36 is fixed to an upper fixture 46, which also includes an annular O-ring groove, and an O-ring, collectively denoted by reference numeral 48. O-ring 48 serves to provide a fluidic seal between assembly 36 and the outer surface of thin sleeve 30. Therefore, hydraulic fluid flowing downwardly within annular space 24 is sealed and restrained from entering axial space 32.

A fixed, scalloped ring 50 is coupled to the outer tube or between bit shank 14 and sub 12, and extends radially inward to an extent sufficient to lie at least partially in a longitudinally interfering position with respect to assembly 36. Ring 50 is scalloped along its inner diameter to allow a greater hydraulic cross section inside of the outer tube. In other words, as inner barrel 28 is moved upward by means well known in the art, and such as shown and described in the copending application entitled A Hydraulic Lift Inner Barrel In A Drill String, Ser. No. 530,492, now U.S. Pat. No. 4,553,613, assigned to the same assignee in the present invention, lower assembly 36 will ultimately come into contact with ring 50. Normally lower assembly 36 is coupled to inner barrel 28 through fixture 46 by means of a conventional shear pin 52. When assembly 36 or upper fixture 46 contacts scalloped ring 50, shear pin 52 will be severed, and assembly 36, together with flapper valves 40, will be longitudinally restrained within the coring tool.

Meanwhile, inner barrel 28, including sleeve 30, will continue to be longitudinally displaced upward within the coring tool. Ultimately, flapper valve 40 will be entirely uncovered. As lower edge 54 of the sleeve 30 clears upper end 56 of flapper valve 40, flapper valve 40 will then be free to rotate inwardly about hinge pin 42 under the urging of spring 44 and possibly the resistance or fall of the cut core within space 32.

Therefore, what has been provided by the embodiment of FIG. 1 is a full closure catcher which is entirely shrouded so that at no point during the coring operation is any portion of the core catcher mechanism exposed to or in contact with the core. Only after the coring has been completed and the inner barrel pulled upwardly will portions of the full closure catcher be exposed to the core and activated.

Figure 2:
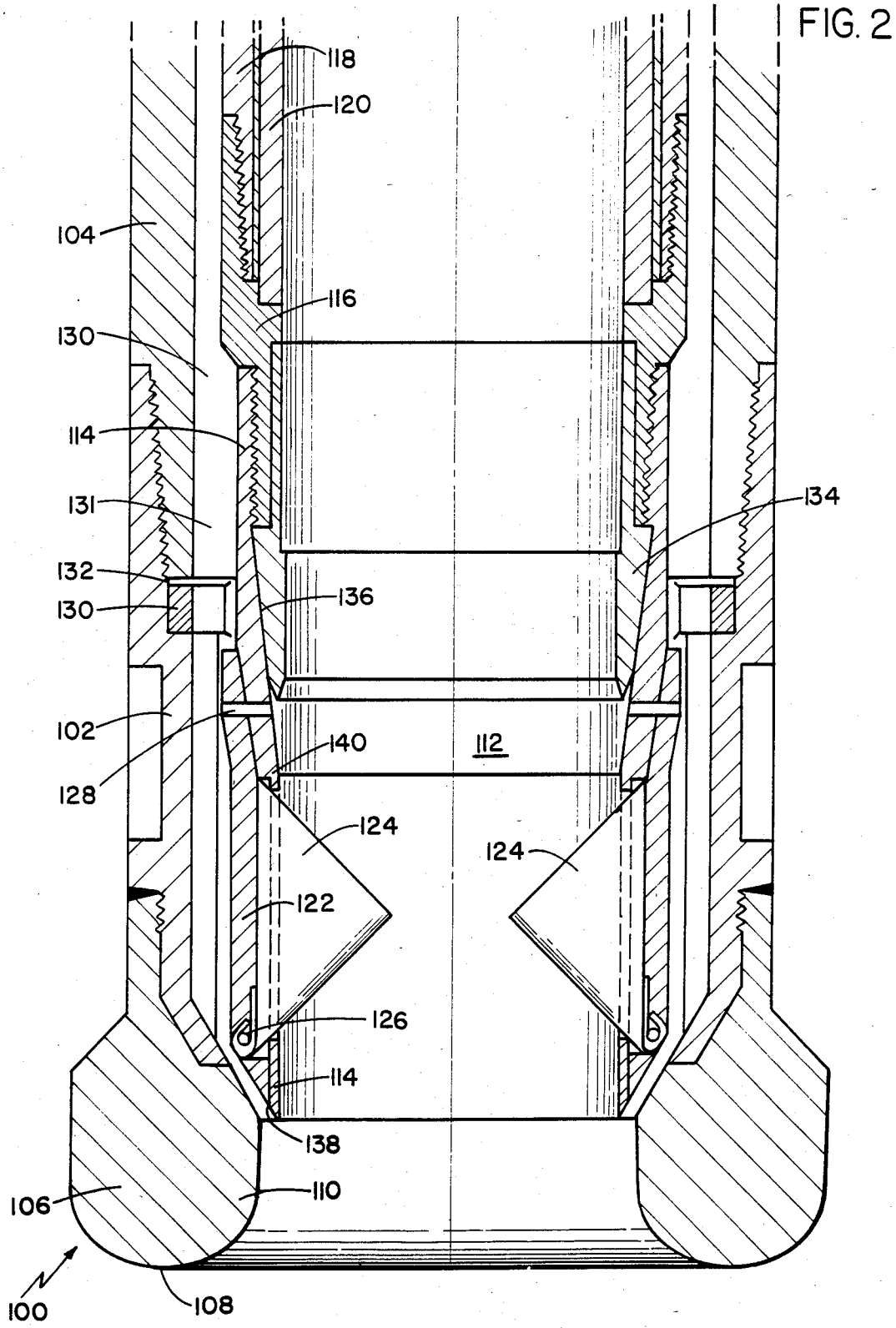
FIG. 2 is a cross-sectional view of a second embodiment of an invention showing a tool which includes a core catcher adapted for consolidated formations, as well as a shrouded full closure core catcher.

Turn now to the second embodiment of FIG. 2 which also shows a cross-sectional view of the lower section of the coring tool incorporating the invention. In the embodiment of FIG. 2, a conventional core catcher, together with a shrouded full closure catcher, is depicted. Once again, the lower portion of the coring tool is comprised of a conventional coring bit, generally denoted by reference numeral 100, which in turn is threadably connected to a bit shank 102. Bit shank 102 in turn is threadably connected to an outer tube 104 of the coring tool. Bit 100 again is characterized by an outer gage 106, a crown 108, and an inner gage 110. The cut core is disposed in a longitudinal, axial space 112 defined within the tool. Beginning at inner gage 110, space 112 is defined by a shroud sleeve 114 extending from inner gage 110 upwardly to core catcher shoe 116, to which it is threadably connected. The core catcher shoe 116 in turn is threadably connected to an inner barrel 118, of which only the lowermost edge is depicted in FIG. 2. Within inner barrel 118 is a closely fitting disposable core sleeve 120, in which the core will ultimately be disposed and stored.

Returning now to the lower portion of the coring tool of FIG. 2, shroud sleeve 114 is concentrically disposed within a lower assembly 122. Between lower assembly 122 and shroud 114 are disposed a plurality of flapper valves 124, which together form a cusped full closure core catcher. Generally, two to four such valves 124 serve in combination to provide a conical closure across axial space 112. Each flapper valve 124 is pivotally coupled to lower assembly 122 about a spring biased pivot pin 126. Again, the spring about pin 126 is a torsion spring arranged and configured to urge each flapper valve 124 radially inward into space 112.

Lower assembly 122 is connected to shroud sleeve 114 by means of a conventional shear pin 128, which extends radially through at least part of assembly 122 and shroud sleeve 114. An outer tube ring 130 is disposed in an annular groove 132 defined by bit shank 102 and outer tube 104. Outer tube ring 130 is scalloped or has a plurality of identations or holes defined therethrough to permit the longitudinal flow of hydraulic fluid through annular space 131. However, outer tube ring 130 extends radially inward to a degree sufficient to cause a longitudinal restraint to be placed upon lower assembly 122 as lower assembly 122 is longitudinally moved upwardly within the coring tool.

Finally, disposed within core catcher shoe 116 and shroud sleeve 114 is a conventional core catcher 134, which allows upper longitudinal displacement of the core therethrough, but which will jam tightly against the core by virtue of a frusto conical interior shape defined on a mutual surface of contact 136 between shroud sleeve 114 and standard core catcher 134.

Consider now the operation of the shrouded core catcher as depicted in FIG. 2. As core bit 100 cuts into the rock formation, a core (not shown) is disposed within axial space 112. Shroud sleeve 114 provides a smooth, cylindrical surface and transition from inner gage 110 of bit 100 up to the lower edge of core catcher 134.

After the core is cut, inner barrel 118 is longitudinally pulled upwardly by means referenced above. In the case of a consolidated core, conventional core catcher 134 will then move downwardly and jam against the core. In any case, as inner barrel 118 continues to be longitudinally displaced upward, lower assembly 122 will ultimately come into contact with outer tube ring 130. This prevents further longitudinal displacement of lower assembly 122. Ultimately, shear pin 128 will sever, allowing shroud sleeve 114 to be drawn upward while lower assembly 122 and connected flapper valves 124 remain in place. As lower edge 138 of shroud sleeve 114 clears upper edge 140 of flapper valves 124, valves 124 will then be free to rotate inwardly under the urging of the spring disposed about pivot pin 126. Therefore, in the event that the core should be fragmented or unconsolidated to any degree, the full closure core catcher will be unshrouded and activated in order to retain the core within the coring tool.

Figure 3:
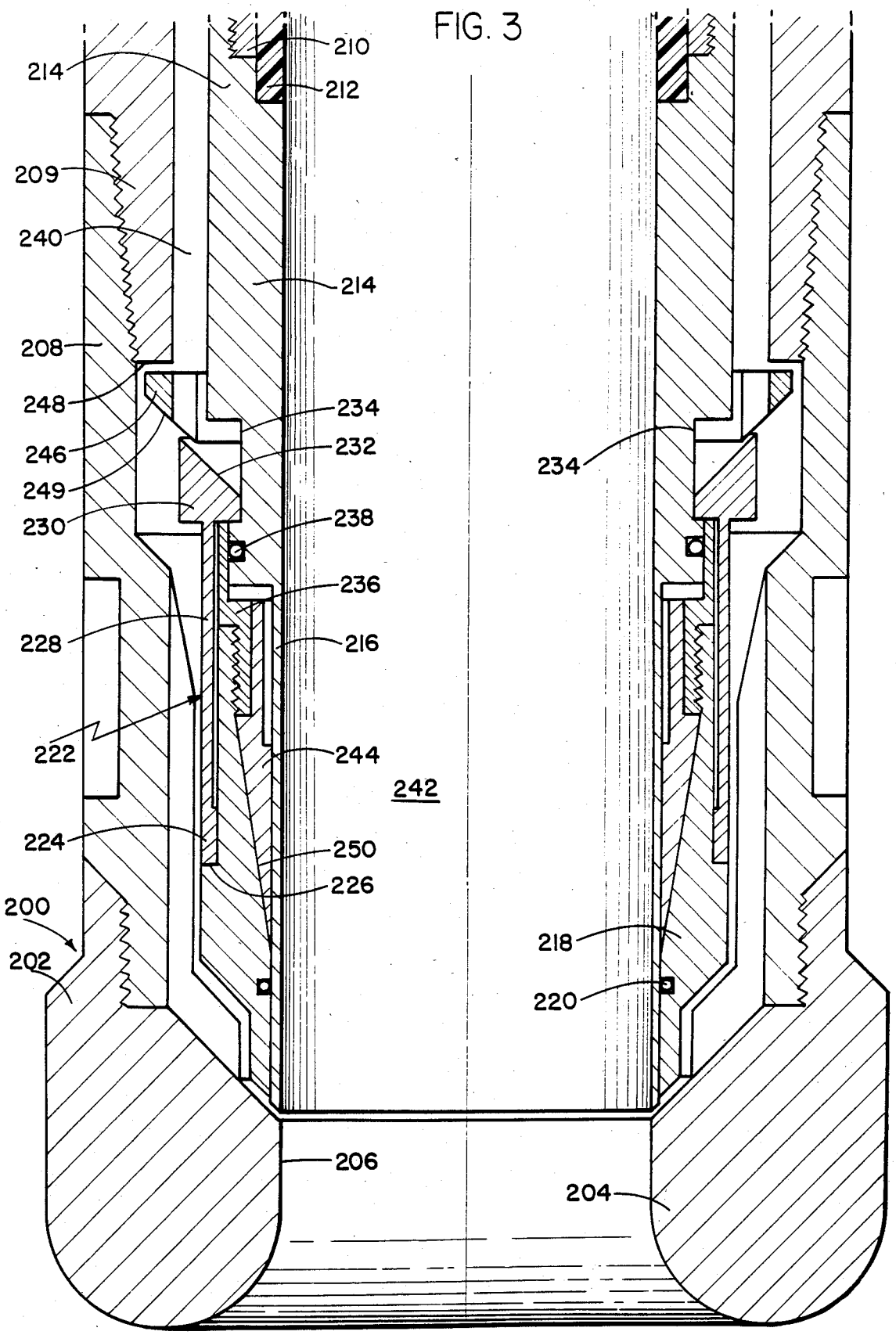
FIG. 3 is a cross-sectional view of a third embodiment of the invention showing a shrouded core catcher which is arranged and configured for consolidated formations.

A diametral interference fit core catcher, together with a shrouded full closure core catcher, having now been described in detail in connection with the embodiment of FIG. 2, turn to yet a third embodiment as depicted in FIG. 3, wherein a diametral interference fit or conventional core catcher is similarly shrouded.

FIG. 3 also illustrates a cross-sectional view of the lower portion of a coring tool incorporating the invention. Again, a coring bit, generally denoted by reference 200, and characterized by an outer gage 202, crown 204, an inner gage 206, is depicted. Bit 200 is similarly connected to the drill string through appropriate shank and ultimately to the outer tube, which are diagrammatically depicted in the illustration of FIG. 3 simply as a shank portion 208 and outer tube sub 209. An inner tube 210 and plastic liner 212, of which only the lower portions are shown in FIG. 3, are threadably connected and concentrically disposed respectively to an inner tube shoe 214. Inner tube shoe 214 extends longitudinally downward and forms a thin, cylindrical sleeve portion 216, which provides a smooth, cylindrical surface all the way from inner gage 206 of bit 200 to plastic liner 212.

Concentrically disposed outside of sleeve 216 is a lower assembly 218. Lower assembly 218 is hydraulically sealed at its lower end to sleeve 216 by means of a conventional O-ring 220. Concentrically disposed about lower assembly 218 is a collet assembly 222. Collet assembly 222 includes a cylindrical basal portion 224, which is disposed within a shoulder 226 of lower assembly 218. Extending from basal portion 224 is a resilient tine 228 extending longitudinally upward and terminating in a collet latch 230. Collet latch 230 is particularly characterized by an outwardly inclined surface 232. In its normal position, collet latch 230 is disposed within an annular indentation 234 defined in the exterior surface of inner tube shoe 214. Therefore, collet latch 230, through tine 228 and the attachment or fit of basal portion 224, serves to retain lower assembly 218 in a first temporarily, longitudinally coupled position with respect to inner tube shoe 214.

An upper cylindrical assembly 236 is threadably coupled to lower assembly 218, and extends upwardly and to the exterior of inner tube shoe 214. An O-ring seal 238 is defined in the surface of mutual overlying contact between upper assembly 236 and inner tube 214, to thereby hydraulically seal outer annular space 240 from axial space 242 into which the core is disposed. Hydraulic fluid thus flows longitudinally downward through space 240 outside of collet assembly 222 and to hydraulic ports within bit 200 and within inner gage 206.

Concentrically disposed within upper and lower assemblies 236 and 218, respectively, is a conventional core catcher 244. Thus, core catcher 244 is radially disposed within the coring tool outside of sleeve 216 extending from inner tube shoe 214 and inside lower assembly 218. Upper assembly 236 also includes a shoulder bearing against an upper edge of core catcher 244, thereby preventing upward longitudinal movement of core catcher 244 relative to upper and lower assemblies 236 and 218, respectively.

Finally, disposed longitudinally above collet latch 230 is a floating outer tube ring 246, which may be scalloped or provided with a plurality of holes to increase its hydraulic cross section. Outer tube ring 246 is provided with an inwardly inclined surface 249, which is arranged and configured to mate with outwardly inclined surface 232 of collet latch 230. Upper longitudinal displacement of outer tube ring 246 is restrained by an interference contact with a lower butt surface 248 of outer tube sub 209.

Consider now the operation of the embodiment of FIG. 3. As the core is cut, it is exposed only to the smooth, continuous inner surface of sleeve 216 of inner tube shoe 214, and ultimately to the contiguous cylindrical, smooth surface of plastic liner 212. After the coring operation is completed, inner barrel 210, together with inner tube shoe 214, will be longitudinally displaced upward by the means referenced above. Lower assembly 218 will thus be longitudinally moved upward inasmuch as it is carried by collet assembly 222. Surface 232 of collet latch 230 will come into contact with surface 249 of floating outer tube ring 246 at some time when ring 246 is longitudinally restrained by the lower butt surface 248 of outer tube sub 209. The mutually inclined and mating surfaces 249 and 232 of ring 246 and collet latch 230, respectively, will cause collet latch 230 to move outward radially as permitted by resilient tine 228. The radially outward displacement of collet latch 230 will eventually release collet assembly 222 from annular groove 234 of inner tube shoe 214. Inner tube shoe 214 continues longitudinally upward while collet assembly 222 and lower assembly 218 coupled thereto are longitudinally restrained. At this time, sleeve 216 begins to move upwardly with respect to core catcher 244. Ultimately, core catcher 244 will be entirely exposed and a diametral interference fit between core catcher 244 and the core (not shown) disposed in axial space 242 will be permitted. Any relative downward movement of the core within the core tool will drive core catcher 244 down the frustoconical mutual surface of contact 250, thereby wedging core catcher 244 tightly into the adjacent core.

Many modifications and alterations may be made by those having ordinary skill in the art without departing from the spirit and scope of the invention. The illustrated embodiments have been shown only by way of example, and should not be taken as limiting the invention as defined in the following claims.

We claim:

1. An improvement in the coring tool for cutting a core and including an inner tube longitudinally displaceable within said coring tool comprising:

a smooth inner cylindrical sleeve for receiving said core;

a core catcher concentrically disposed outside said sleeve and concealed from said core; and means coupled to said sleeve and core catcher for temporarily longitudinally connecting said core catcher and said sleeve in a first configuration, and for selectively disconnecting said core catcher and said sleeve in a second configuration to allow relative longitudinal displacement of said sleeve with respect to said core catcher to unconceal said core catcher with respect to said core;

wherein said means for connecting and selectively disconnecting said core catcher and sleeve is concentrically disposed outside of said core catcher;

wherein said means for connecting and selectively disconnecting said core catcher and sleeve longitudinally restrains said core catcher within said coring tool, and then selectively disconnects said sleeve from said core catcher, thereby permitting said core catcher to become unconcealed, whereby interfering contact between said core catcher and said core is substantially eliminated.

2. The improvement of claim 1, wherein said means for coupling and selectively decoupling said core catcher and said sleeve comprises a lower assembly, said core catcher being longitudinally fixed with respect to said lower assembly, and means coupled to said lower assembly for temporarily coupling said lower assembly to said sleeve, and then for selectively longitudinally restraining and fixing said lower assembly in said coring tool.

3. The improvement of claim 2, wherein said means for coupling and restraining comprises shear pins disposed through said lower assembly and sleeve for coupling said core catcher and sleeve, and an outer tube ring radially extending within said coring tool to provide an interference contact with said lower assembly, said outer tube ring being longitudinally fixed with respect to said coring tool.

4. An improvement in a coring tool for cutting a core comprising:

a core catcher disposed within said coring tool;

a smooth, cylindrical sleeve disposed in said coring tool and concentrically disposed inside of said core catcher, said sleeve fully covering said core catcher and providing a smooth, continuous surface of contact to said core, said sleeve being selectively displaceable with respect to said core catcher to ultimately fully uncover said core catcher; and means for selectively activating said core catcher, wherein said core catcher is full closure catcher, and said means for activating said core catcher comprises spring means for resiliently urging said full closure core catcher radially inward after said full closure core catcher has been uncovered by relative longitudinal displacement of said sleeve;

wherein said means for activating said core catcher being rotatably coupled to said lower assembly, said lower assembly being temporarily coupled to said inner tube and selectively detachable therefrom to allow relative longitudinal displacement between said sleeve and said lower assembly; and wherein said means for activating said core catcher comprises an outer tube ring longitudinally fixed with respect to said coring tool, and extending radially inward to provide a longitudinal restraint to said lower assembly, said lower assembly being detached from said sleeve when selectively brought into contact with said outer tube ring, said sleeve continuing to be longitudinally displaceable within said coring tool and with respect to said full closure core catcher after longitudinal restraint of said lower assembly within said coring tool, whereby disruptive contact between said core catcher and said core is substantially eliminated.

5. The improvement of claim 4, wherein a second core catcher is disposed within said sleeve, said second core catcher being a diametral interference fit core catcher and having an exterior frustoconical surface in contact with a mating interior frustoconical surface of said sleeve.

6. An improvement in a coring tool for cutting a core comprising:

a core catcher disposed within said coring tool;

a smooth, cylindrical sleeve disposed in said coring tool and concentrically disposed inside of said core catcher, said sleeve fully covering said core catcher and providing a smooth, continuous surface of contact to said core, said sleeve being selectively displaceable with respect to said core catcher to ultimately fully uncover said core catcher; and means for selectively activating said core catcher, wherein said core catcher is a diametral interference fit core catcher having an outward frustoconical shape;

wherein said means for activating said core catcher comprises a lower assembly and a collet assembly coupled to said lower assembly, said core catcher being disposed concentrically within said lower assembly, said collet assembly for temporarily longitudinally fixing said lower assembly with respect to said sleeve, longitudinally upward displacement of said inner tube activating said collet assembly to detach itself from said sleeve, thereby longitudinally restraining said lower assembly within said coring tool, and permitting said sleeve to be longitudinally displaced with respect to said lower assembly and core catcher disposed thereon, whereby disruptive contact between said core catcher and said core is substantially eliminated.

7. An improvement in the coring tool for cutting a core and including an inner tube longitudinally displaceable within said coring tool comprising:

a smooth inner cylindrical sleeve for receiving said core;

a core catcher concentrically disposed outside said sleeve and concealed from said core; and means coupled to said sleeve and core catcher for temporarily longitudinally coupling said core catcher and said sleeve in a first configuration, and for selectively decoupling said core catcher and said sleeve in a second configuration to allow relative longitudinal displacement of said sleeve with respect to said core catcher to unconceal said core catcher with respect to said core, wherein said means for coupling and selectively decoupling said core catcher and sleeve is concentrically disposed outside of said core catcher;

wherein said means for coupling and selectively decoupling said core catcher and sleeve longitudinally restrains said core catcher within said coring tool, and then selectively decouples said sleeve from said core catcher, thereby permitting said core catcher to become unconcealed;

wherein said means for coupling and selectively decoupling said core catcher and said sleeve comprises a lower assembly, said core catcher being longitudinally fixed with respect to said lower assembly, and means coupled to said lower assembly for temporarily coupling said lower assembly to said sleeve, and then for selectively longitudinally restraining and fixing said lower assembly in said coring tool;

wherein said means for coupling and restraining comprises a collet assembly coupled to said lower assembly, said collet assembly resiliently and temporarily attaching to said sleeve, and an outer tube ring longitudinally fixed with respect to said coring tool, said outer tube ring radially extending within said coring tool to provide an interference contact with said collet asssembly, said outer tube ring detaching said collet assembly from said sleeve when in contact with said collet assembly, whereby interfering contact between said core catcher and said core is substantially eliminated.

* * * * *